US012049721B2

(12) United States Patent
Civanelli et al.

(10) Patent No.: US 12,049,721 B2
(45) **Date of Patent: *Jul. 30, 2024**

(54) LAUNDRY TREATING APPLIANCE WITH INDUCTION HEAT

(71) Applicant: WHIRLPOOL CORPORATION, Benton Harbor, MI (US)

(72) Inventors: Claudio Civanelli, Travedona Monate (IT); Davide Parachini, Cassano Magnago (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/107,852

(22) Filed: Feb. 9, 2023

(65) Prior Publication Data

US 2023/0183911 A1 Jun. 15, 2023

Related U.S. Application Data

(62) Division of application No. 16/701,503, filed on Dec. 3, 2019, now Pat. No. 11,598,042.

(Continued)

(51) Int. Cl.
*D06F 39/04* (2006.01)
*D06F 25/00* (2006.01)

(Continued)

(52) U.S. Cl.
CPC ..... *D06F 39/04* (2013.01); *D06F 25/00* (2013.01); *D06F 58/04* (2013.01); *D06F 58/16* (2013.01); *D06F 58/24* (2013.01); *D06F 58/30* (2020.02); *D06F 2103/36* (2020.02); *D06F 2105/24* (2020.02)

(58) Field of Classification Search
None
See application file for complete search history.

(56) References Cited

U.S. PATENT DOCUMENTS 7,481,083 B2 * 1/2009 Habu ..... D06F 58/24 68/19.2
2006/0137105 A1 6/2006 Hong et al.

(Continued)

FOREIGN PATENT DOCUMENTS

CN 104846609 A 8/2015
CN 108360230 A 8/2018

(Continued)

OTHER PUBLICATIONS

European Search Report for Counterpart EP20162471.5, Dated Aug. 7, 2020.

(Continued)

*Primary Examiner* — Rita P Adhlakha
(74) *Attorney, Agent, or Firm* — McGarry Bair PC

(57) ABSTRACT

A combination washer/dryer having a cabinet defining an interior, a tub provided within the interior, and a drum rotatably provided within the tub and defining a treating chamber, an induction coil carried by the tub and generating a magnetic field encompassing at least a portion of the container, and a cooling element providing on at least one of the tub or closure to form a cooled surface in fluid communication with the treating chamber.

19 Claims, 10 Drawing Sheets

Related U.S. Application Data

(60) Provisional application No. 62/825,341, filed on Mar. 28, 2019.

(51) Int. Cl.

| | |
|---|---|
| ***D06F 58/04*** | (2006.01) |
| ***D06F 58/16*** | (2006.01) |
| ***D06F 58/24*** | (2006.01) |
| ***D06F 58/30*** | (2020.01) |
| ***D06F 103/36*** | (2020.01) |
| ***D06F 105/24*** | (2020.01) |

(56) References Cited

U.S. PATENT DOCUMENTS

| | | | |
|---|---|---|---|
| 2017/0233919 | A1 | 8/2017 | Lee |
| 2018/0057995 | A1 | 3/2018 | Kim et al. |
| 2018/0057996 | A1 | 3/2018 | Park et al. |
| 2019/0048509 | A1 | 2/2019 | Kim et al. |
| 2019/0048510 | A1 | 2/2019 | Kim et al. |
| 2019/0048511 | A1 | 2/2019 | Kim et al. |
| 2019/0048512 | A1 | 2/2019 | Noh et al. |
| 2019/0048513 | A1 | 2/2019 | Jang et al. |
| 2019/0048515 | A1 | 2/2019 | Noh et al. |
| 2019/0048516 | A1 | 2/2019 | Kim et al. |
| 2019/0048517 | A1 | 2/2019 | Park et al. |
| 2019/0062981 | A1 | 2/2019 | Kim et al. |

FOREIGN PATENT DOCUMENTS

| | | | |
|---|---|---|---|
| DE | 2716721 | A1 | 4/1978 |
| DE | 102009026646 | A1 | 12/2010 |
| DE | 102014208514 | A1 | 11/2015 |
| EP | 2350376 | B1 | 2/2016 |
| EP | 3246451 | A1 | 11/2017 |
| EP | 3287559 | A1 | 2/2018 |
| EP | 3375930 | A2 | 9/2018 |
| EP | 3441514 | A1 | 2/2019 |
| JP | 2004166744 | A | 6/2004 |

OTHER PUBLICATIONS

Chinese Office Action for Counterpart CN201911393393.6, Dated Jul. 6, 2023, 9 Pages.

* cited by examiner

LAUNDRY TREATING APPLIANCE WITH INDUCTION HEAT

CROSS-REFERENCE TO RELATED APPLICATIONS

The present application is a divisional application of U.S. patent application Ser. No. 16/701,503, filed on Dec. 3, 2019, now U.S. Pat. No. 11,598,042, issued Mar. 7, 2023, which application claims the benefit of U.S. Provisional Patent Application No. 62/825,341, filed on Mar. 28, 2019, both of which are incorporated herein by reference in their entirety.

BACKGROUND

Laundry treating appliances, such as clothes washers, clothes dryers, combination washer/dryers, refreshers, and non-aqueous systems, can have a configuration based on a rotating drum that defines a treating chamber having an access opening through which laundry items are placed in the treating chamber for treating. The laundry treating appliance can have a controller that implements a number of pre-programmed cycles of operation having one or more operating parameters.

In laundry treating appliances with drying systems, typically a heater and a blower are provided in an air conduit in order to move heated process air through the conduit and into the treating chamber to evaporate water from a load of laundry. In a traditional, open-loop, drying system, the blower then moves the water-laden air to an exterior of the laundry treating appliance, typically outside of the building housing the laundry treating appliance. In a less traditional, closed-loop, drying system, like a heat pump drying system, the water-laden air is passed through a condenser to remove the water, and the process air is heated again by the heater and blown back into the treating chamber to continue the process.

BRIEF SUMMARY

In one aspect, the description relates to a combination clothes washer and dryer comprising a tub defining a tub interior, the tub having a peripheral wall and a sump, a rotatable container made from electromagnetic material and located within the tub interior, at least a portion of the container being made and at least partially defining a laundry treating chamber with an access opening, a closure selectively closing the access opening, a motor operably coupled to and rotatably driving the rotatable container, an induction coil carried by the tub and generating a magnetic field encompassing at least a portion of the container, and a cooling element providing on at least one of the tub or closure to form a cooled surface in fluid communication with the treating chamber. Whereby energization of the induction coil heats the container to evaporate liquid in the treating chamber into vapor, which contacts the cooled surface, where the vapor is condensed and is delivered to the sump.

In another aspect, the description relates to a combination clothes washer and dryer comprising a tub defining a tub interior, the tub having a peripheral wall and a sump, a rotatable container made from electromagnetic material and located within the tub interior, at least a portion of the container being made and at least partially defining a laundry treating chamber with an access opening, a closure selectively closing the access opening, a motor operably coupled to and rotatably driving the rotatable container, an induction coil carried by the tub and generating a magnetic field encompassing at least a portion of the container, and a header comprising multiple spray nozzles and extending axially along an interior wall of the tub defining a cooled surface on the interior wall of the drum which is in fluid communication with the treating chamber and the sump. Whereby energization of the induction coil heats the container to evaporate liquid in the treating chamber into vapor, which contacts the cooled surface, where the vapor is condensed and is delivered to the sump.

DETAILED DESCRIPTION

Aspects of the present disclosure relate to a drying system for a laundry treating appliance. The drying system uses induction heating to heat a treating chamber holding the laundry to generate water vapor and a cooling liquid flow to condense the water vapor. The drying system can be used in any type of laundry treating appliance needing to dry laundry, such laundry treating appliances can be a clothes dryer or a combination washer/dryer (combo).

Traditional combo washer/dryer appliances are based on the combined structure of a traditional washing machine and clothes dryer contained within a cabinet having an industry-standard form factor, suitable for a stand-alone washer or dryer, and must house both washing and drying systems, the treating chamber volume, typically defined by a rotatable drum, is generally smaller than a typical stand-alone drying appliance. Even with typically lesser capacity, combo machines are very convenient for users who have limited space and/or low laundry volumes.

Traditional drying systems include a blower to drive heated drying air or process air into and out of the drum during a drying cycle. The blower drives the air through a heater, to heat the air, and into the drum where the heated air aids in the evaporation of water from the load to form water-laden air, and the blower moves the water-laden air out of drum. For the most common type of dryer, an open loop system is used, where the water laden air is expelled to the surrounding environment. For condensing type dryers, a closed loop system is used where the water laden air is passed through a condenser to remove the water and then recirculated.

The blower generates a lot of noise relative to the other components of the drying system. Any reduction in operational noise of a laundry treating appliance is typically considered a positive by a user of the appliance. The blower also takes up space that could be used to increase the size of the treating chamber, such as the drum, thereby increasing the capacity of laundry treating appliance, or reduce the form factor of the laundry treating appliance. The drying system of this disclosure eliminates the blower, which is beneficial in reducing the noise of the drying system and providing for increased capacity or smaller form factor of the corresponding laundry treating appliance.

Figure 1:
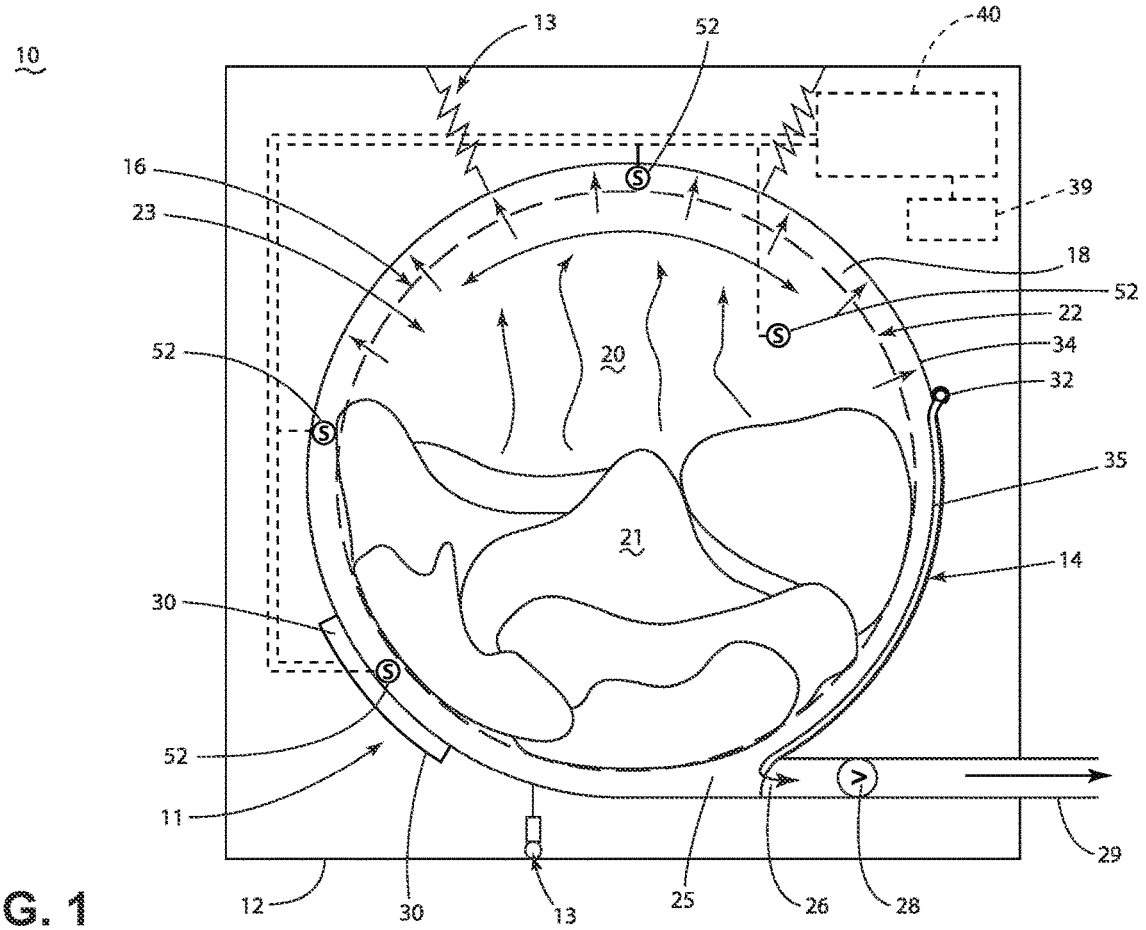
FIG. 1 is a schematic view of a laundry treating appliance, illustrated as a combination washer/dryer, incorporating a drying system according to an aspect of the disclosure.

FIG. 1 is a schematic view of a laundry treating appliance, illustrated in the form of a combo washer/dryer 10 incorporating a blower-less drying system 11. The drying system 11 can be used in any suitable laundry treating appliance and is not limited to combo washing/drying machines.

While the laundry treating appliance described herein has a horizontal axis, the exemplary laundry treating appliance is not limited to implementations in a horizontal axis laundry treating appliance. Depending on the implementation, a vertical axis dryer or a combination washing machine and dryer; a tumbling or stationary refreshing/revitalizing machine; an extractor; or a non-aqueous washing apparatus; can all be suitable environments for the disclosure as described herein.

The combination washer/dryer 10 as illustrated in FIG. 1 includes a structural support system comprising a cabinet 12. The cabinet 12 can be a housing having a chassis and/or a frame defining an interior enclosing components typically found in a conventional washer and dryer or combo washer/dryer, including but not limited to motors, pumps, fluid lines, controls, sensors, transducers, and the like. Only components necessary for a complete understanding of the disclosure set forth herein will be described in more detail as necessary.

A laundry holding system is located within the interior of the cabinet 12 and includes a tub 14 supported within the cabinet 12 by a suitable suspension system 13, and a drum 16 located within the tub 14 and separated by a space 18 between the tub 14 and the drum 16. The drum 16 is mounted for rotation relative to the tub 14. An interior of the drum 16 at least partially defines a laundry treating chamber 20 configured to hold a laundry load 21. The drum 16 includes perforations 22 fluidly coupling the laundry treating chamber 20 to the tub 14 and further defines an access opening 23. A door (FIG. 6) can be provided to close the access opening 23.

The combination washer/dryer 10 can also include a recirculation and drain system for recirculating liquid and draining liquid from the combination washer/dryer 10. Liquid supplied to the tub 14 typically enters the space 18 between the tub 14 and the drum 16 and can flow by gravity to a sump 25, which while illustrated as being formed in part by a lower portion of the tub 14, it could be remote from the tub. For example, the sump 25 can also be formed by a sump conduit 26, fluidly coupling the lower portion of the tub 14 to a pump 28. The pump 28 can direct liquid to a drain conduit 29, which can drain the liquid from the combination washer/dryer 10, or, alternatively, to a recirculation system to recirculate and direct the liquid back into the drum 16 or the tub 14.

The combination washer/dryer 10 also includes a heating system for providing heat to a washing system and/or the drying system 11 of the combination washer/dryer 10. The heating system includes an induction heater that generates an electromagnetic field for providing heat to the heating system. The inductor, illustrated as an induction coil 30, can be mounted to the tub 14. When tub-mounted, at least the portion of the tub 14 to which the inductor coil 30 is mounted should be made of an electromagnetically transparent material to allow the electromagnetic energy to pass through the tub 14. However, the inductor coil 30 could be mounted to a location where the magnetic field need not pass through the tub 14.

As part of the heating system, the drum 16 should be comprised of a ferromagnetic material in order for the magnetic field from the inductor coil 30 to heat the drum 16 via an electromagnetic coupling. For example, the drum 16 can include a suitable ferromagnetic stainless steel, such as AISI 430. Alternatively, the drum 16 can be formed of other types of commonly used stainless steel, such as austenitic steel AISI 304 or AISI 316, however, a ferromagnetic stainless steel is preferred to preserve system efficiency and decrease manufacturing costs. While the entire drum 16 is illustrated as being made from ferromagnetic material, it is contemplated that less than all of the drum can be made from ferromagnetic material, such as the drum having strips of ferromagnetic material.

The combination washer/dryer 10 further includes a condensing system to condense water vapor generated by the drying system 11. The condensing system can include a condenser, which is illustrated as a cooling water supply assembly 32 emitting a cooling water layer 35 on at least a portion of the interior wall 34. The cooling water layer 35 can flow along the interior wall 34 of the tub 14, through the pump 28, and exit via the drain outlet 29 as illustrated by the arrows in FIG. 1.

Figure 2:
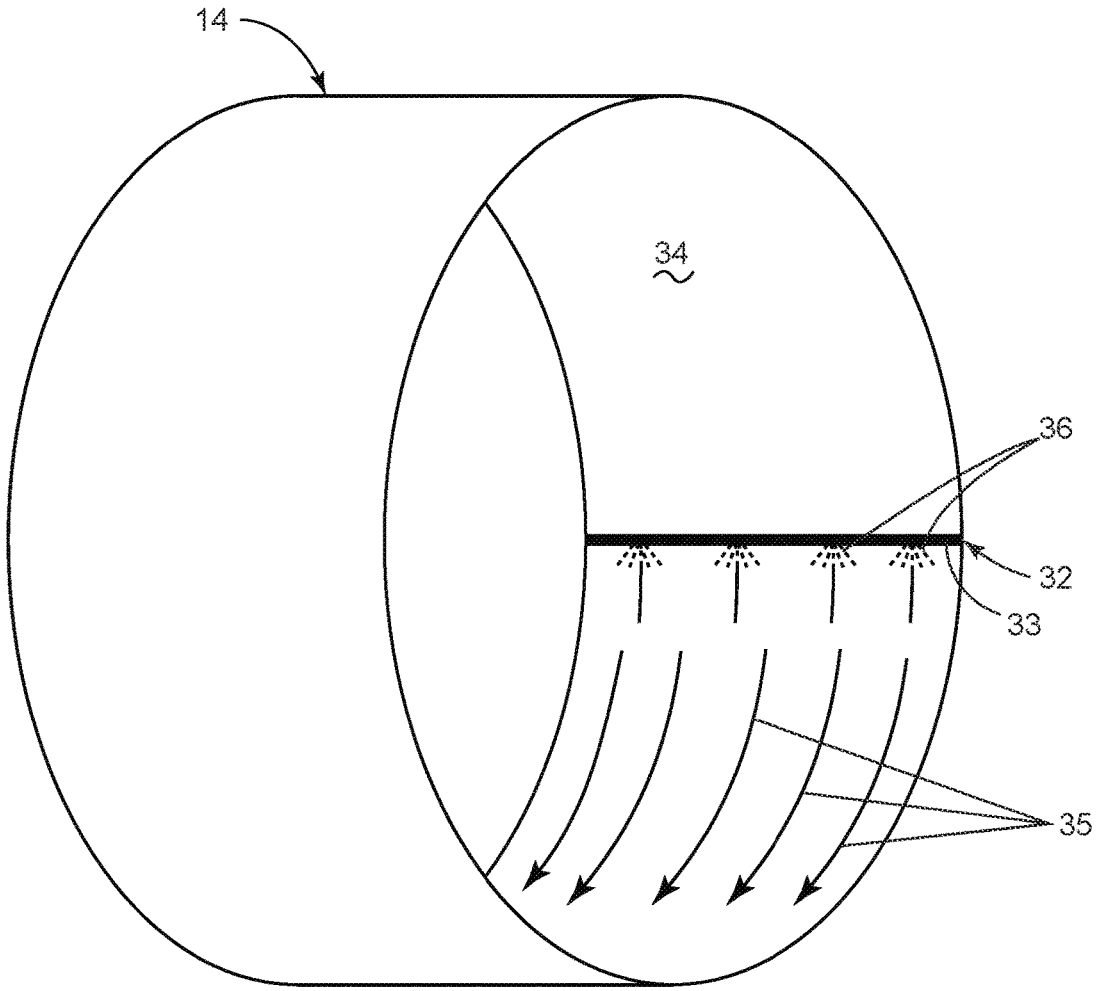
FIG. 2 is a schematic view of a tub illustrating a cooling water supply assembly of the drying system for the combination washer/dryer of FIG. 1.

FIG. 2 is a schematic view of the tub 14, with the drum 16 removed for clarity, to better illustrate the cooling water supply assembly 32 of the drying system 11. As illustrated, the cooling water supply assembly 32 is a header 33 extending axially along the interior wall 34 of the tub 14. The header 33 has a plurality of holes or nozzles 36. The nozzles 36 can be of any suitable shape or size and can be in adjacent relation to one another, forming a row, or can be spaced apart along the interior wall 34. The header 33 is connected to a household water supply, such as by a valve. Alternatively, a pump can be provided to draw water from the tub 14. In a contemplated implementation, the cooling water supply assembly 32 can supply water at a predetermined variable flow rate, for example, between 0.1-2.5 Liters/minute.

Figure 3:
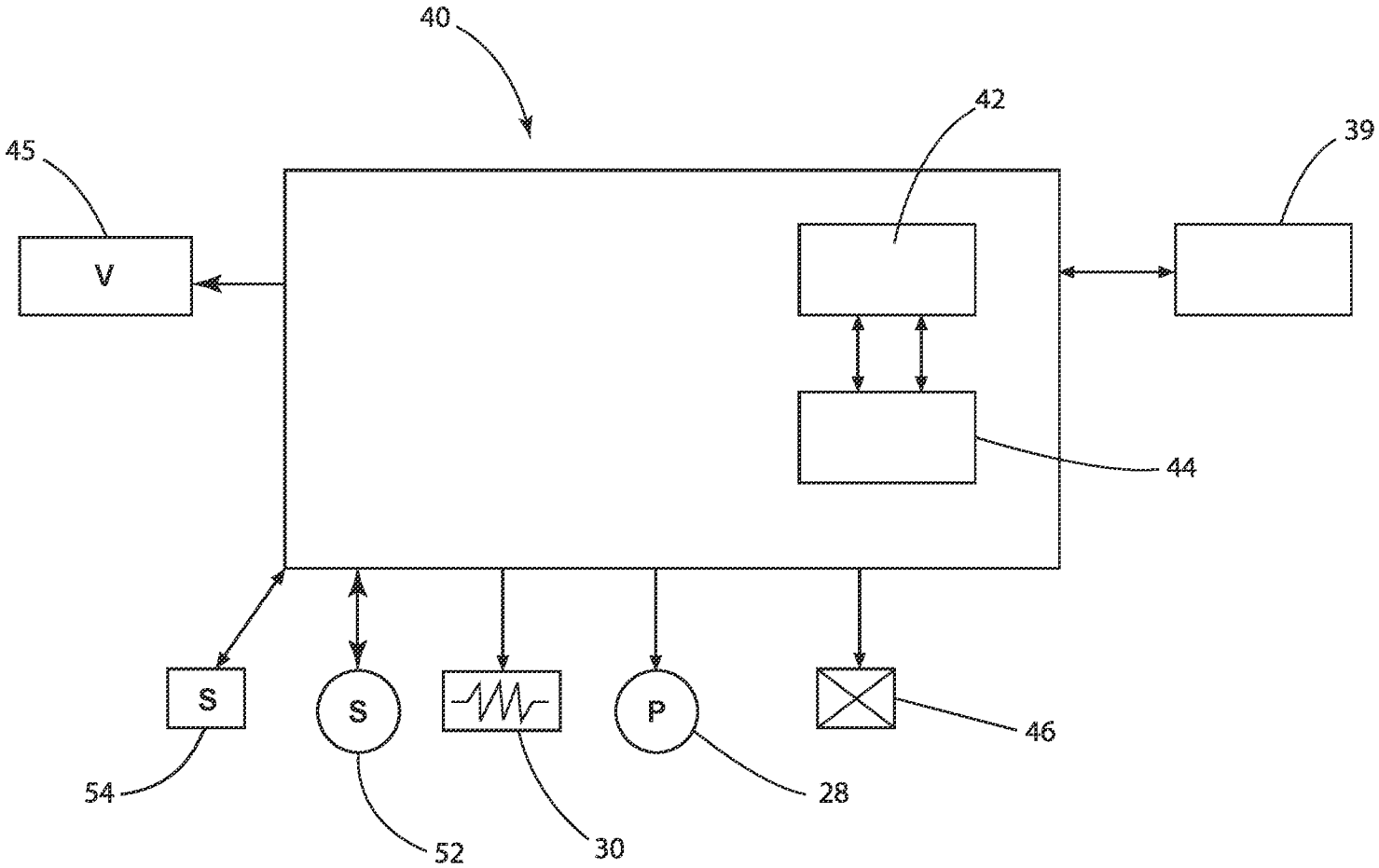
FIG. 3 is a schematic of a control system of the laundry treating appliance of FIG. 1.

FIG. 3 is a schematic view of the controller 40 for the combination washer/dryer 10. The controller 40 can be provided with a memory 42 and a central processing unit (CPU) 44. The memory 42 can be used for storing the control software that is executed by the CPU 44 in completing a cycle of operation using the combination washer/dryer 10 and any additional software. The memory 42 can also store information, such as a database or table, and to store data received from one or more components of the combination washer/dryer 10 that may be communicably coupled with the controller 40. The database or table can store the various operating parameters for the one or more cycles of operation, including factory default values for the operating parameters and any adjustments to them by the control system or by user input.

The controller 40 can be operably coupled with one or more components of the combination washer/dryer 10 for communicating with and controlling the operation of the component to implement a cycle of operation. For example, the controller 40 can operably couple with a variable flow-rate valve 45 to control the flow of water through the cooling water assembly 32. Further, the controller 40 can operably couple with the pump 28, the induction coil 30, and one or more other components 46 of the combination washer/dryer 10 including but not limited to a motor, a dispenser, a steam generator, a sump heater, a heating element, blower, thermistor, thermostat, thermal fuse, thermistor, moisture sensor, valves, and pumps to control the operation of these and other components to implement one or more of the cycles of operation.

The controller 40 can also be coupled with one or more temperature sensors 52. The one or more temperature sensors 52 are configured to measure the temperatures of the surface of the drum 16, the surface of the tub 14, and/or the interior of the laundry treating chamber 20. The one or more temperature sensors 52 can be an infrared (IR) temperature sensor, or a typical temperature sensor such as an NTC, PTC, or TC. The one or more temperatures sensors 52 can be an optical device and can include a protection feature, such as a mechanical shutter, to protect the sensor from damage caused by water, treating chemistry, foam, dirt or other conditions inside the treating chamber 20 and/or the drum 16. The one or more temperature sensors 52 can be provided to the tub 14, the drum 16, and/or beneath an induction center of the inductor. Advantageously, the one or more temperature sensors 52 can be placed above the maximum water level of the water during a washing or rinsing cycle such as at a top portion of the tub 14 or a rear wall of the drum 16. Optionally, a coating can be applied to the drum 16 or the tub 14 to improve or enable reliable operation of the one or more temperature sensors 52.

The controller 40 can also be coupled with one or more sensors 54 provided in one or more of the systems of the combination washer/dryer 10 to receive input from the sensors, which are known in the art and not shown for simplicity. Non-limiting examples of sensors 54 that may be communicably coupled with the controller 40 include: a treating chamber temperature sensor, a moisture sensor, a weight sensor, a chemical sensor, a position sensor and a motor torque sensor, which may be used to determine a variety of system and laundry characteristics, such as laundry load inertia or mass. When the one or more temperature sensors 52 is provided to the tub 14, the data received from the one or more sensors 52 by the controller 40 can be extrapolated by means of an algorithm to determine the temperature of the drum 16 from the available one or more sensors 54 and the operating conditions based on experimental data and/or physical model of the systems.

The controller 40 is also operably coupled to the user interface 39 to receive input from the user through the user interface 39 for the implementation of a cycle of operation. The user interface 39 can include operational controls such as dials, lights, knobs, levers, buttons, switches, and displays enabling the user to input commands to a controller 40 and receive information about a treatment cycle of operation from components in the combination washer/dryer 10 or via input by the user through the user interface 39. The user can enter many different types of information, including, without limitation, fabric type, cycle selection and cycle parameters, such as cycle options.

In an exemplary method of operation, a user can select a predetermined cycle or fabric type of the laundry load at the user interface 39. Optionally, one or more of the sensors 54 can send input to the controller 40 such that the controller 40 can determine the optimal cycle parameters for the laundry load. During a cycle of operation, the one or more temperature sensors 52 send temperature input to the controller 40 allowing the controller 40 to monitor and control the temperature of the combination washer/dryer 10 as well as the operation of other components of the combination washer/dryer 10.

During a washing cycle, the induction coil 30 is energized to heat the drum 16 while the drum 16 is rotating and the heated drum 16 is continuously immersed in washing liquid in a bottom portion of the tub 14 as in a typical wash cycle. The drum 16 transfers heat to the washing liquid and the laundry load 21 in the treating chamber 20 is heated by both contact with the washing liquid and with the heated surface of the drum 16 while the drum 16 is rotating.

During a spinning cycle, the induction coil 30 is energized to heat the drum 16. The laundry load 21 is in turn heated by contact with the surface of the heated drum 16. Heating the laundry load 21 lowers the viscosity of the water, thereby increasing the mechanical water extraction during spinning which increases the efficiency of the spinning cycle and lowering the water content in the laundry load 21 at the beginning of a drying cycle. In turn, the lowered water content of the laundry load 21 at the beginning of a drying cycle decreases the drying cycle time required saving time and energy costs for the user.

During a drying cycle, the controller energizes the induction coil 30 to heat the drum 16. To avoid hot spots, the drum 16 is rotated as the induction coil 30 heats the drum. In one implementation, it is contemplated that the drum 16 is rotated at a speed where the laundry 21 tumbles in the drum 16. The direction of rotation can be reversed during rotation. If the direction of rotation is reversed, the output of the induction coil 30 can be reduced as the drum 16 slows down and goes through the change in rotational direction to prevent a temporary hot spot.

During the energizing of the induction coil 30, the surface of the drum 16 is heated, and the heat is transferred by conduction, convection and radiation to the laundry load 21, with the primary heat transfer being through conduction. As the temperature of the laundry load 21 increases, the vapor pressure of the liquid held by the laundry load 21 also increases, which causes the liquid to begin evaporating (FIG. 1).

To effect a condensing of the water vapor, the controller 40 activates the cooling water supply assembly 32 to form the cooling water layer 35 on the interior wall 34 of the tub 14. The vapor pressure at the interior wall 34 of the tub 14 cooled by the cooling water layer 35 is lower than the vapor pressure at the surface of the heated drum 16 or inside the heated drum 16 in the treating chamber 20 as the water is evaporating. This vapor pressure difference drives the water vapor from high vapor pressure (inside the drum) to low vapor pressure (outside the drum). The perforations 22 in the drum 16 provide a path for the water vapor to flow from the drum 16 to the cooling water layer 35. When the water vapor reaches and contacts the cooling water layer 35, the water vapor condenses on the cooling water layer 35, where it is carried along with the cooling water layer 35 to the sump 25.

The controller 40 can actuate the pump 28 to drain the cooling water with the condensed water vapor out the drain outlet 29 (FIG. 1). The cycle continues until the laundry load 21 is determined dry, which can be time based or sensor based.

Figure 4:
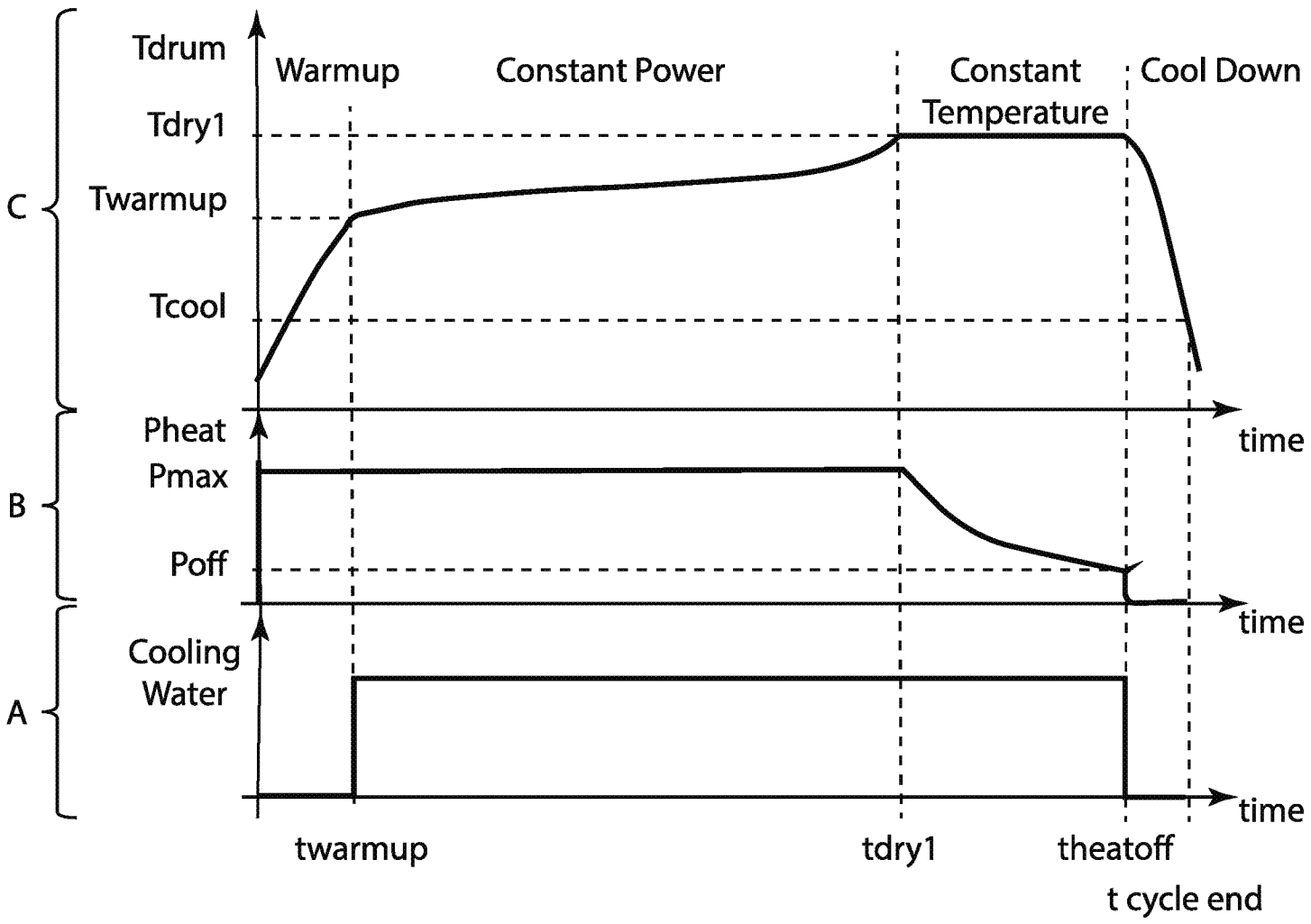
FIG. 4 is a cycle diagram illustrating cycle parameters during a method of operating the drying system of FIG. 1.

FIG. 4 illustrates the relationship between the relevant system temperatures (Section A), power consumed by the induction coil (Section B), and the use of cooling water (Section C) during an exemplary cycle of operation of the drying system for the combination washer/dryer. The cycle of operation can be divided into four phases, identified as Warmup, Constant Power, Constant Temperature, and Cool Down, all over time as identified on the X-axis. The time interval (t) for each phase may or may not be predetermined. In the illustrated, time (t) is a function of the time required to reach a predetermined temperature during the relevant phase of the cycle of operation. Alternatively, time (t) can be a function of a predetermined cycle time.

During the Warmup phase, the cooling water can be turned off, and the consumed power of the induction coil, Pheat, is at a maximum (Pmax), which increases the temperature of the drum, Tdrum, at a maximum rate from an initial drum temperature, (Tcool), until the temperature reaches a predetermined warmup temperature, (Twarmup). Tcool is typically ambient temperature, assuming sufficient time has elapsed since the last cycle of operation, and Twarmup is between 50-70° C. depending upon the cycle of operation and/or fabric type of the laundry load. The fabric type (cotton, synthetics, or a mix) can be input to the controller by the user or can be deduced by the controller based on selected cycle of operation. The amount of power supplied to the induction coil is a function of the particular induction coil and power supply. In most household implementations, it is contemplate that Pmax is approximately 2 kW for the selected induction coil. However, it is further contemplated that suitable induction heaters will have a Pmax of 0.5 kW to 6 kW.

During the Constant Power phase, after Tdrum reaches Twarmup, the controller 40 turns on the cooling water flow by actuating the cooling water assembly 32. Pheat remains at Pmax, while the drum 16 is rotating, and Tdrum continues to increase from Twarmup to Tdry1, which is typically between 60-100° C. depending upon the cycle of operation and/or fabric type of the laundry load 21. The turning on of the cooling water is delayed until Twarmup is reached because the rate of water vapor generation is typically relatively low that, from a practical standpoint, insufficient water vapor would reach the cooling water to provide beneficial condensation, which, in an open-loop system where the cooling water is drained and not re-circulated, it would lead to unnecessary water usage. Further, the flow rate of the water can optionally be varied by actuation of the variable flow-rate valve 45 in response to the amount of water vapor present and/or rate of water vapor generated in the treating chamber 20. The temperature Tdry1 is normally selected based on the type of fabric expected in the laundry load 21. For cottons and similar materials, the temperature Tdry1 can be between 90-100° C. For synthetics, the temperature Tdry1 can be less than 80° C.

During the Constant Temperature phase, Tdrum remains at Tdry1 to avoid any unwanted impact on the fabric of the laundry load 21, while Pheat is slowly decreased to maintain the temperature at Tdry1. Varying the power, Pheat, to keep the temperature at Tdry1 ensures a maximum rate of water vapor generation while still operating at a temperature safe for the fabrics of the laundry load 21.

The Constant Temperature phase is terminated when the power, Pheat, reaches a predetermined value (Poff). This predetermined value Poff, can be indicative of a dry load. For example, as the water is removed in the form of water vapor from the laundry load 21, less energy is required to convert the remaining water to water vapor. Thus, Pheat can be used to indicate the degree of dryness of the laundry load 21 and it can be empirically or experimentally determined at what value Pheat indicates the desired degree of dryness. When Pheat reaches that value at Poff, the Constant Temperature phase can be terminated. While Pheat can be used as a dryness indicator, it need not be so. Other sensors 54 could be used, such as a traditional conductivity sensor, to determine dryness. Additional, a time-based dry could be used as well.

After the laundry load 21 reaches the desired degree of dryness, however it is determined, in the Constant Temperature phase, the Cool Down phase begins. The Cool Down phase need only run long enough to cool the laundry 21 so that it can be comfortably handled by the user. At the beginning of the Cool Down phase (theatoff), the cooling water and power to the induction coil 30 are turned off and the drum 16 is rotated to help remove the heat.

During the cycle of operation of the drying system 11 of combo washer/dryer 10, the drum 16 typically rotates at a speed of approximately 40-70 rpm to tumble the laundry load 21. Tumbling can periodically stop in order for the drum 16 to begin rotation in an opposite direction to avoid entanglement of the laundry load 21. Preferrably, power to the induction coil 30 is supplied only while the drum 16 is rotating to avoid local concentration of energy to a portion of the drum 16 that may cause local high temperatures, or 'hot spots'. When the drum 16 is stopped, power to the inductor coil 30 can also be stopped to avoid hot spots and restarted when rotation of the drum 16 resumes.

Figure 5:
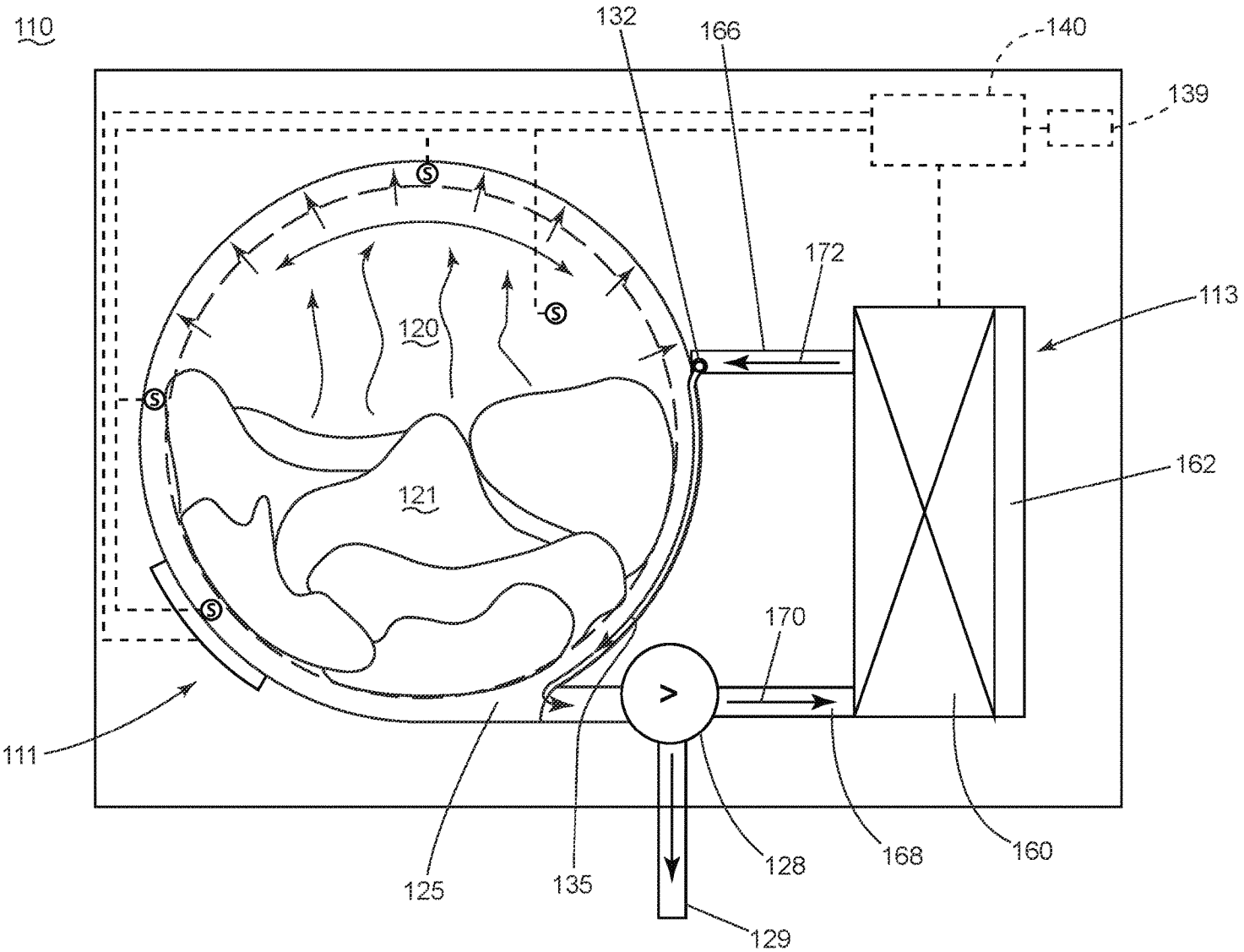
FIG. 5 is a schematic view of a drying system in a laundry treating appliance in the form of a combination washer/dryer according to another aspect of the disclosure.

FIG. 5 is a schematic view of a variation to the drying system 11 as previously described for the combo washer/dryer 10 and illustrated in combo washer/dryer 110. As this variation has many similar parts as previously described, like parts are identified with like numerals increased by 100, with it being understood that the description of the like parts of the combo washer/dryer 10 apply to the combo washer/dryer 110 unless otherwise noted.

The drying system 111 of combo washer/dryer 110 primarily differs from the drying system 11 of combo washer/dryer 10 in that the cooling water is recycled/reused in the drying system 111 of the combo washer/dryer 110, to form a closed-loop system, whereas the cooling water of the combo washer/dryer 10 was drained away to form an open-loop system. In the closed loop system, the cooling water is heated by the water vapor as it condenses with the cooling water. If the cooling water is not cooled after being heated by the condensed water vapor, the vapor pressure differential between the water vapor and the cooling water will reduce, leading to a reduction in the rate of condensation and increasing the time it takes to dry the load or to reach the desired degree of dryness.

To effect a closed loop system as shown in FIG. 5, a recirculation system 113 is added, which includes a heat exchanger 160. The recirculation system 113 recirculates the cooling water from the sump 125 back to the cooling water supply assembly 132, while passing it through the heat exchanger 160 along the way to cool the cooling water. The recirculation system 113 includes an inlet conduit 168, which supplies liquid from the sump 125 to the heat exchanger 160, and an outlet conduit 166, which supplies liquid from the heat exchanger 160 to the cooling water supply assembly 132. The drain pump 128 can be used as a recirculation pump for the recirculation system 113. Alternatively, a separate recirculation can be provided in addition to the drain pump 128.

The heat exchanger 160 can be any suitable heat exchanger. As illustrated, the heat exchanger 160 includes a thermoelectric plate 162 to cool the heat exchanger 160 and thereby cool the water passing through the heat exchanger 160. The heat exchanger 160 could be a fin type heat exchanger, with the thermoelectric plate cooling the fins.

During the drying cycle, as the layer of cooling water 135 condenses the evaporating liquid from the laundry load 121, the water vapor will transfer heat to the cooling water layer 135. Once the cooling water layer 135 reaches a predetermined threshold temperature, the water can be pumped from the sump 125, via pump 128, out the drain conduit 129 or into the recirculation system 113 to be recirculated.

In the recirculation system 113, the cooling water 135 mixed with condensate from the drying cycle of operation is pumped in the direction of arrow 170 to the heat exchanger 160 via heat exchange inlet conduit 168. The thermoelectric plate 162 is operably controlled by the controller 140 to cool the water passing through the heat exchanger 160 as the water flows toward the heat exchange outlet conduit 166. The pump 128 continues to pump the water in the direction of arrow 172, through the heat exchange outlet conduit 166 and toward the cooling water assembly 132 to be reused to form the cooling water layer 135.

Alternatively, instead of the thermoelectric plate 162, the heat exchanger 160 can be an air heat exchanger where outside air can be used to cool the incoming cooling water 135 mixed with condensate. Optionally, a cooling fan (not shown) can be included in the system to blow outside air over the heat exchanger 160 to cool the incoming cooling water 135 mixed with condensate prior to recirculation. The heat exchanger 160 can be located inside or outside of the combo washer/dryer 110.

Figure 6:
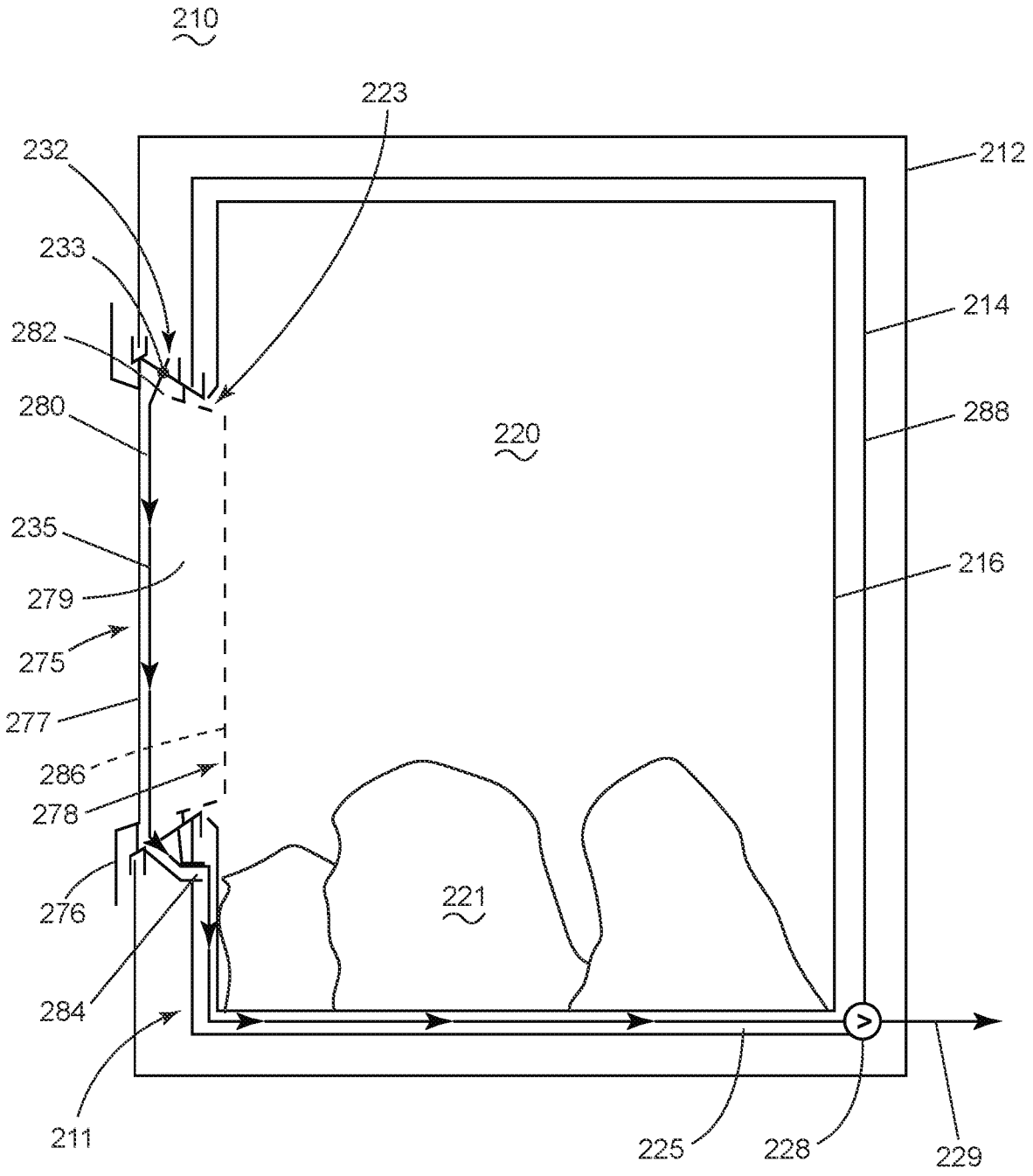
FIG. 6 is a schematic view of a drying system in a laundry treating appliance in the form of a combination washer/dryer according to another aspect of the disclosure.

FIG. 6 is a schematic view of another variation to the drying system 11, 111 for the combo washer/dryer 10, 110 and illustrated in combo washer/dryer 210. As this variation has many similar parts as previously described, like parts are identified with like numerals increased by 100, with it being understood that the description of the like parts of the combination washer/dryer 10 and 110 apply to the combination washer/dryer 210 unless otherwise noted.

The drying system 211 of the combination washer/dryer 210 primarily differs from the drying system 11, 111 of combo washer/dryer 10, 110 in that the cooling water assembly 232 is mounted to a door assembly 275 and not to an interior wall of the tub 214. The door assembly 275 can provide the surface along which the cooling water will flow. As the door assembly 275 is adjacent the open end of the drum 216, the water vapor can travel more freely to the cooling water flow as it does not have to pass through the perforations in the drum 216.

The door assembly 275 is movably mounted relative to the cabinet 212 to selectively close the access opening 223 and the laundry treating chamber 220. The door assembly 275 includes a frame 276 supporting an outer front panel 277, can be a transparent pane, a rear panel 278, can be a transparent pane or bowl, which define an interior 279 between the front and rear panels 277, 278. A cooling surface 280 is located within the interior 279. The frame 279 has an inlet 282 and an outlet 284 fluidly coupled to the interior 279. A vent 286 can be provided in at least one of the rear panel 278 or frame 276.

The cooling water assembly 232 has a header 233 fluidly coupled to the inlet 282, whereby water emitted from the header 233 can enter the inlet 282 and flow down the cooling surface 280 and exit the outlet 284, where the cooling water flow then flows to the sump 225.

In operation, the water vapor is formed as previously described and then travels through the vent 286 to contact the cooling water flow 235 on the cooling surface 280 to condense the water vapor.

While the cooling surface 280 is illustrated within the door assembly 275, it is contemplated that the cooling surface 280 can be in other locations, like the rear panel 278, where the cooling water flow 235 runs along the rear panel 278 and into the tub 214. Alternatively, the cooling surface 280 can be provided at a rear surface 288 of the tub 214.

An advantage to the drying system 211 is that the cold surface is farther away from the heated area of the drum 216, which limits the possible thermal energy loss, while allowing for a smaller area to be cooled, therefore conserving water and energy.

Figure 7:
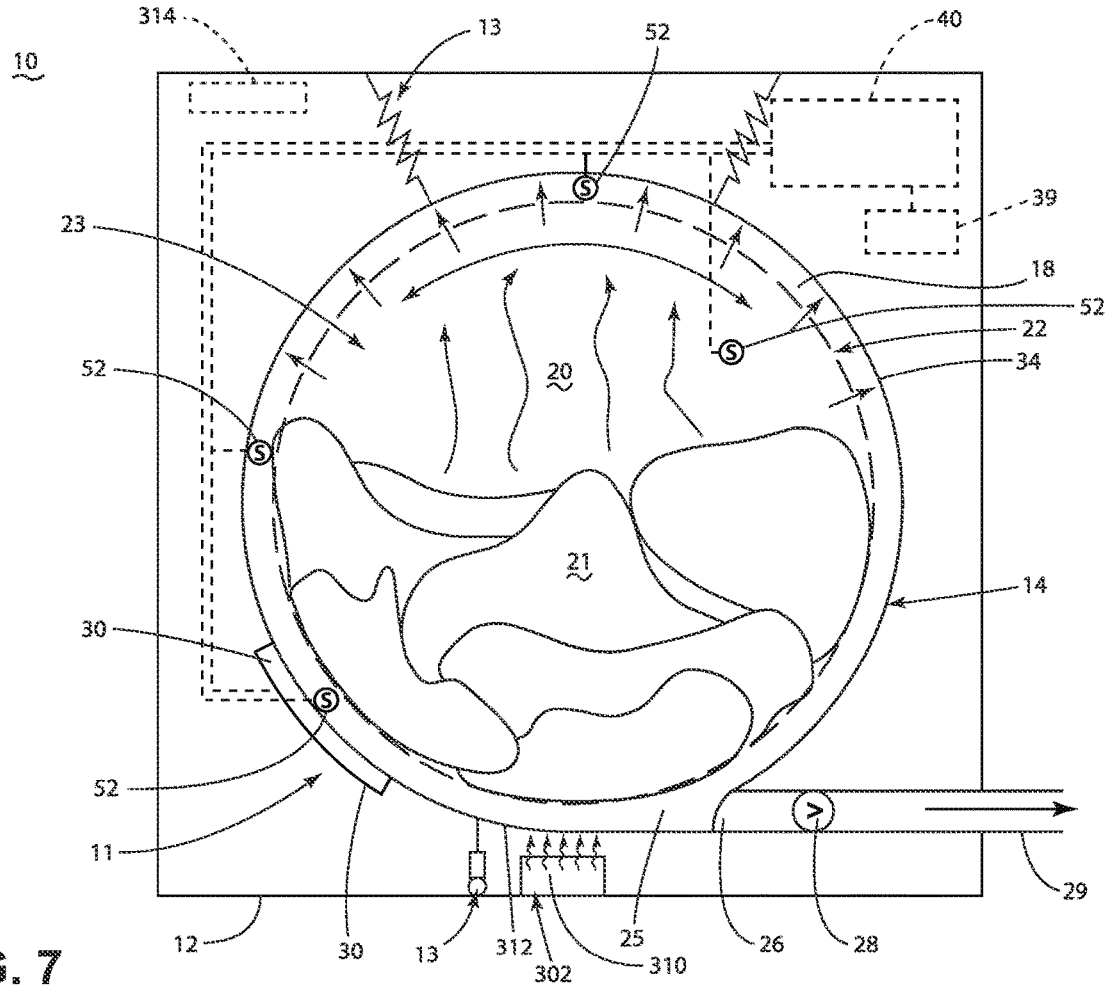
FIG. 7 is a schematic view of the laundry treating appliance of FIG. 1, incorporating a drying system according to another aspect of the disclosure.

FIG. 7 is a schematic view of the combo washer/dryer 10 of FIG. 1 where the cooling water supply assembly 32 of the condensing system has been replaced by an air-based system 302 comprising a forced air fan 310 configured to blow ambient cooling air toward the tub 14 to form a cooling surface 312. While the forced air fan 310 can be provided in any location in the cabinet 12, forming the cooling surface 312 at a lower portion of the tub 14 provides for the water vapor to condense on the tub 14, underneath the drum 16, where the condensed water can flow by gravity into the sump 25 for processing. In contrast, if the cooling surface 312 where on a portion of the tub 14 above the drum 16, the water vapor would condense on the tub 14, and possibly fall by gravity onto the drum 16, where the condensed water could flow back into the drum 16 through the perforations 22. Therefore, the forced air fan 310 is contemplated to be on a portion of the tub 14 or cabinet 12 where the condensed water is less likely to re-enter the drum 16. The air flow from the fan 310 can flow from the lower portion of the cabinet 12 through a top or rear vent 314 in the cabinet 12.

Figure 8:
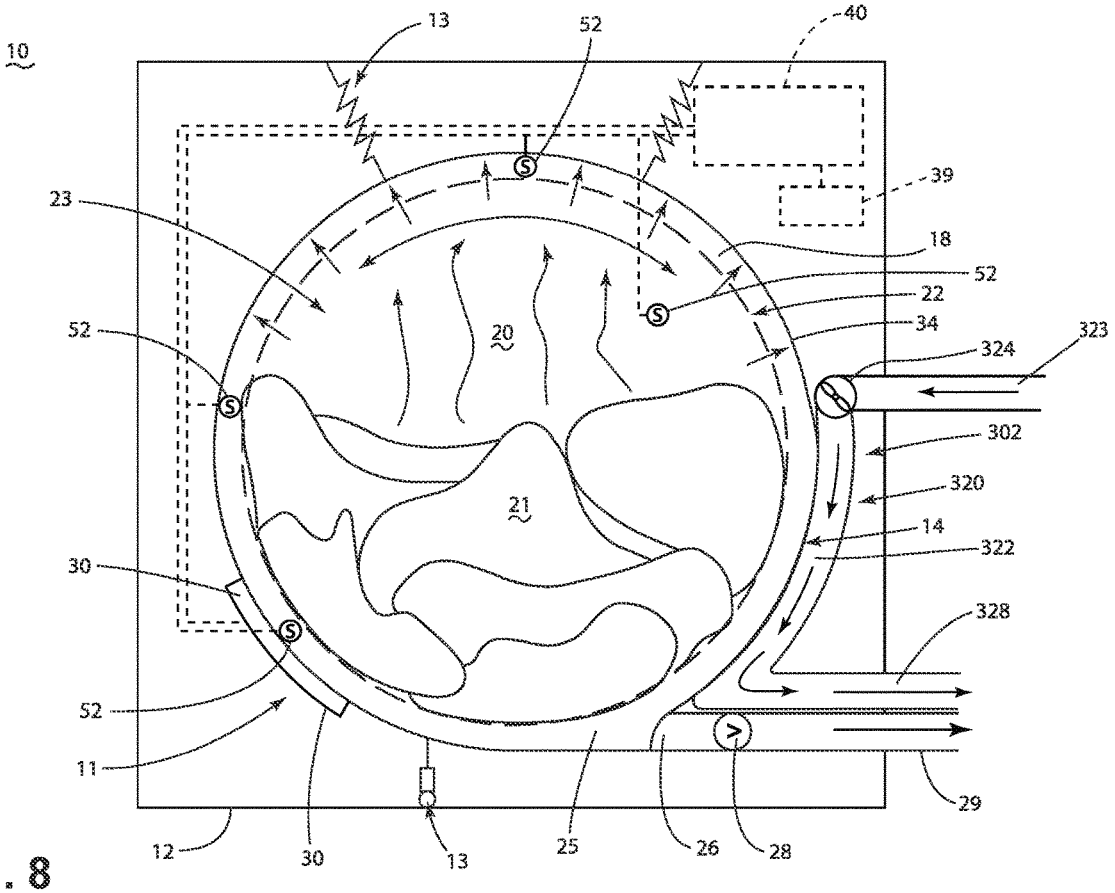
FIG. 8 is a schematic view of the laundry treating appliance of FIG. 7, incorporating a drying system according to another aspect of the disclosure.

While FIG. 7 shows an unguided cooling air flow, that is, an air flow not flowing through a dedicated duct, FIG. 8 is a schematic view of the combo washer/dryer 10 of FIG. 7, with a guided air flow, where the air-based system 302 includes a cooling air duct 320 having a heat exchange portion 322 abutting or formed by part of the tub 14, which is supplied air by an inlet portion 323, and from which air is exhausted by an exhaust portion 328. A fan 324 can be fluidly coupled to the cooling air duct 320 to force cooling air through the cooling air duct 320. As illustrated, the fan 324 is located at the junction of the inlet portion 323 and the heat exchange portion 322, but it could be anywhere relative to the cooling air duct.

The inlet and exhaust portions 323, 328 can be of the same/different size relative to each other and to the heat exchange portion 322. It is contemplated that the heat exchange portion 322 would be substantially coextensive with the portion of the tub 16 that the heat exchange portion 322 overlies. The heat exchange portion 322 could also be a more complex heat exchanger as compared to a simple duct.

Figure 9:
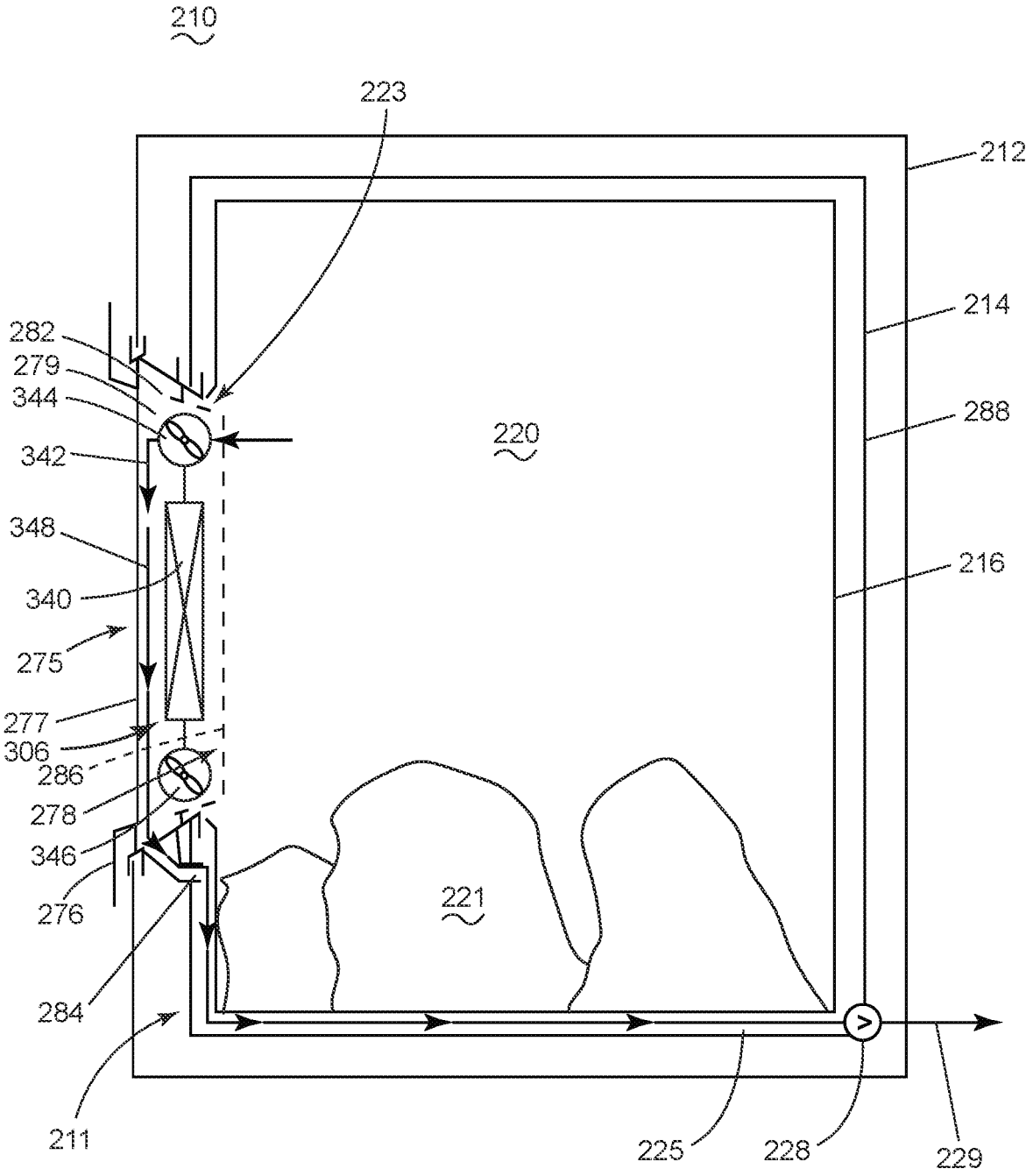
FIG. 9 is a schematic view of the laundry treating appliance of FIG. 6, incorporating a drying system according to another aspect of the disclosure.

FIG. 9 is a schematic view of the combo washer/dryer 210 of FIG. 6 where the cooling water supply assembly 232 of the condensing system has been replaced with an air based system 306 comprising an air-to-air heat exchanger 340 provided in the door assembly 275. Humid air 342 is drawn from the drum 216 through the vent 286 by a forced air fan 344. The humid air 342 passes over the air-to-air heat exchanger 340. A cooling fan 346 blows cooling air, such as ambient air, over the heat exchanger 340 to condense water 348 out of the humid air 342. The condensed water 348 can then be drained via a pump 228 through a drain conduit 229.

Figure 10:
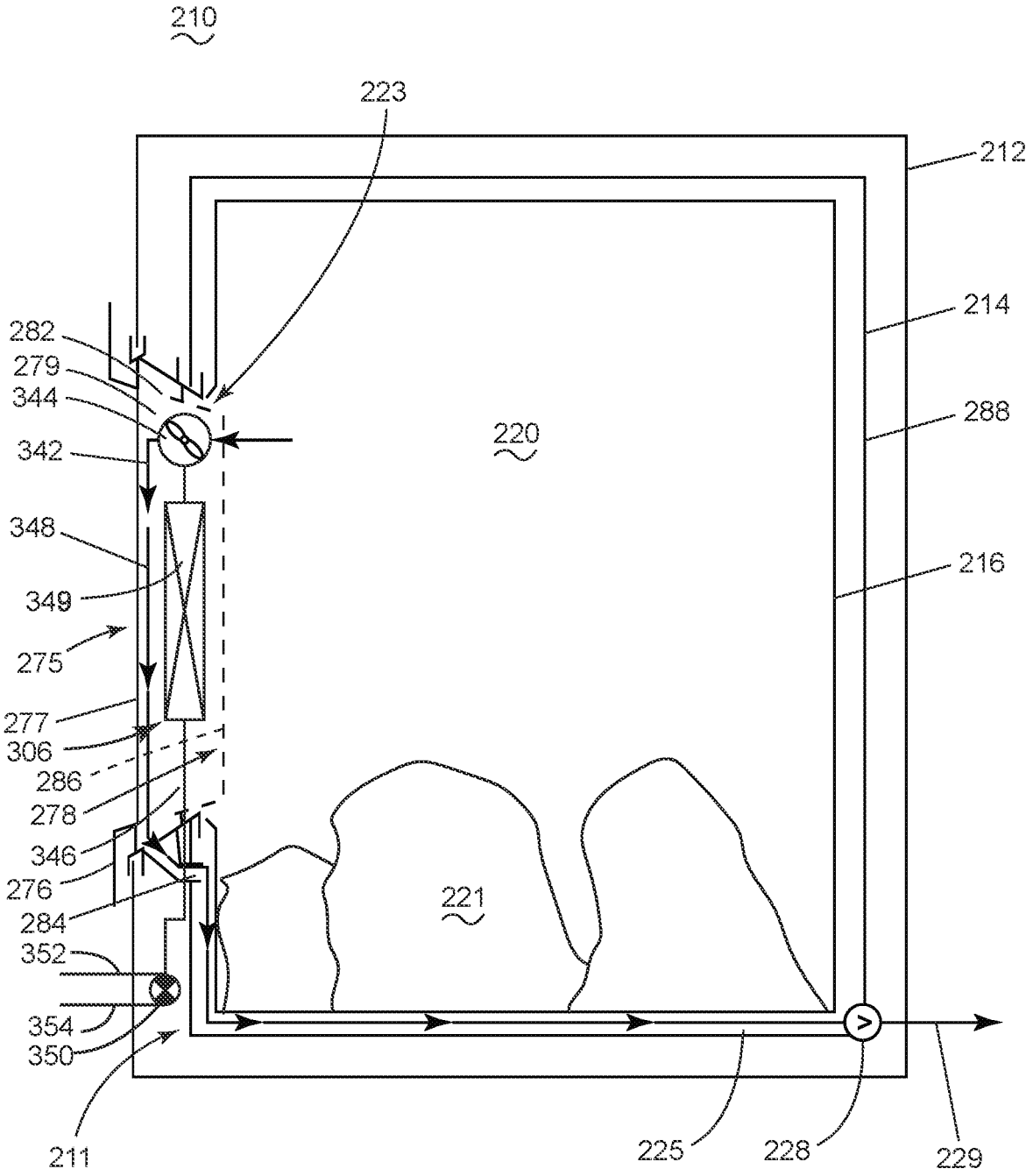
FIG. 10 is a schematic view of the laundry treating appliance of FIG. 9, incorporating a drying system according to another aspect of the disclosure.

FIG. 10 is a schematic view of the combo washer/dryer 210 of FIG. 9 where the air-to-air heat exchanger 340 is replaced with a water-cooled heat exchanger 349. A valve 350 fluidly connects the water-cooled heat exchanger 349 with a cooling water inlet 352 and a cooling water outlet 354. The cooling water inlet 352 can be connected to a household water supply and the cooling water outlet 354 can be connected to a drain such that water provided to the water-cooled heat exchanger 349 can be maintained at a desired temperature in which to exchange heat with the humid air 342 from the drum 216. Alternatively, the cooling water inlet 352 and the cooling water outlet 354 can be fluidly connected to a secondary heat exchange system (not shown) configured to recycle the cooling water provided to the water-cooled heat exchanger 349. During operation of the combo washer/dryer 210, the humid air 342 is drawn from the drum 216 through the vent 286 by a forced air fan 344. The humid air 342 passes over the water-cooled heat exchanger 349 to condense the water 348 from the air 342. The condensed water 348 can then be drained via a pump 228 through a drain conduit 229.

Advantages of the air-based condensing systems in FIGS. 7-9 are water and energy conservation resulting from the use of air to form a cooling surface in the condensing system instead of water. This conservation in turn reduces the cost of operation for a user. Similarly, conservation of water and energy are also advantages to the condensing system in FIG. 10, because while the heat exchanger is water cooled, less water would be consumed by the water-cooled heat exchanger due to the smaller area.

The aspects of the disclosure described herein disclose a laundry treating appliance, for example, a dryer or a combination washer/dryer, as well as a laundry treating method for said laundry treating appliance, wherein induction heating can be leveraged in a drying system. Using induction heating eliminates the need for a heater, a blower, and air conduit system in the appliance. This results in an increased appliance capacity and larger treatment chamber volumes as well as reduced manufacturing costs. In addition, the elimination of a blower in aspects of the disclosure results in a virtually noiseless drying operation.

The combination washer/dryer 10 can further include all the systems typically required for performing laundry treating operations, portions of which are not illustrated herein for the sake of brevity, including but not limited to, a drive system for rotating the drum 16 within the tub 14, a liquid supply system for supplying water to the combination washer/dryer 10 for use during a cycle of operation that can include a source of water, such as a household supply, a dispensing system for dispensing treating chemistry to the treating chamber 20 during a cycle of operation, and a control system for controlling the operation of the combination washer/dryer 10 located within the cabinet 12 and including a user interface 39 operably coupled with the control system and includes a controller 40.

To the extent not already described, the different features and structures of the various aspects can be used in combination with others as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure.

The invention claimed is:

1. A combination clothes washer and dryer comprising:

a tub defining a tub interior, the tub having a peripheral wall and a sump;

a rotatable container made from electromagnetic material and located within the tub interior, at least a portion of the rotatable container being made and at least partially defining a laundry treating chamber with an access opening;

a closure selectively closing the access opening;

a motor operably coupled to and rotatably driving the rotatable container;

an induction coil carried by the tub and generating a magnetic field encompassing at least a portion of the rotatable container; and a cooling element provided on the closure to form a cooled surface in fluid communication with the laundry treating chamber;

whereby energization of the induction coil heats the container to evaporate liquid in the laundry treating chamber into vapor, which contacts the cooled surface, where the vapor is condensed and is delivered to the sump.

2. The combination clothes washer and dryer of claim 1 wherein the cooling element comprises an evaporator.

3. The combination clothes washer and dryer of claim 1 wherein the rotatable container is a perforated drum that rotates about a horizontal axis.

4. A combination clothes washer and dryer comprising:

a tub defining a tub interior, the tub having a peripheral wall and a sump;

a container made from electromagnetic material and rotatably located within the tub interior, at least a portion of the container at least partially defining a laundry treating chamber with an access opening;

a closure selectively closing the access opening;

a motor operably coupled to and rotatably driving the container;

an induction coil carried by the tub and generating a magnetic field encompassing at least a portion of the container; and a header comprising multiple spray nozzles and extending axially along an interior wall of the tub and defining a cooled surface on the interior wall of the tub, which is in fluid communication with the laundry treating chamber and the sump;

whereby energization of the induction coil heats the container to evaporate liquid in the laundry treating chamber into vapor, which contacts the cooled surface, where the vapor is condensed and is delivered to the sump.

5. The combination clothes washer and dryer of claim 4 wherein the cooled surface is located exteriorly of the laundry treating chamber.

6. The combination clothes washer and dryer of claim 4 wherein the spray nozzles are fluidly connected to a water supply.

7. The combination clothes washer and dryer of claim 6 wherein the multiple spray nozzles define a water curtain.

8. The combination clothes washer and dryer of claim 7 wherein the water curtain is fluidly coupled to the sump.

9. The combination clothes washer and dryer of claim 4 wherein the cooled surface extends axially across a width of the tub.

10. The combination clothes washer and dryer of claim 9 wherein the cooled surface extends circumferentially around at least a portion of the tub.

11. The combination clothes washer and dryer of claim 4 wherein an entire container is made from the electromagnetic material.

12. The combination clothes washer and dryer of claim 4 wherein the container comprises at least one of a perforated basket configured to rotate about a vertical axis or a perforated drum configured to rotate about a horizontal axis.

13. A combination clothes washer and dryer comprising:

a tub defining a tub interior, the tub having a peripheral wall and a sump;

a container made from electromagnetic material and rotatably located within the tub interior, at least a portion of the container at least partially defining a laundry treating chamber with an access opening;

a closure selectively closing the access opening;

a motor operably coupled to and rotatably driving the container;

an induction coil carried by the tub and generating a magnetic field encompassing at least a portion of the container; and a header comprising multiple spray nozzles and defining a cooled surface on the tub interior or the closure, the cooled surface in fluid communication with the laundry treating chamber and the sump;

whereby energization of the induction coil heats the container to evaporate liquid in the treating chamber into vapor, which contacts the cooled surface, where the vapor is condensed and is delivered to the sump.

14. The combination clothes washer and dryer of claim 13 wherein the is in fluid communication with a water supply assembly and extends axially along an interior wall of the tub.

15. The combination clothes washer and dryer of claim 14 wherein the multiple spray nozzles comprise a water curtain flowing down a portion of the peripheral wall to the sump.

16. The combination clothes washer and dryer of claim 13 wherein the cooled surface comprises an air curtain.

17. The combination clothes washer and dryer of claim 16 wherein the air curtain comprises ambient air flowed over a portion of the tub or closure.

18. The combination clothes washer and dryer of claim 13 wherein the cooled surface extends axially across a width of the tub.

19. The combination clothes washer and dryer of claim 18 wherein the cooled surface extends circumferentially around at least a portion of the tub.

* * * * *